United States Patent [19]

Jones

[11] 4,413,592

[45] Nov. 8, 1983

[54] WATER DAMAGE PREVENTER PAN

[76] Inventor: George D. Jones, 4926 Harford Rd., Baltimore, Md. 21214

[21] Appl. No.: 428,134

[22] Filed: Sep. 29, 1982

[51] Int. Cl.[3] ..... F22B 37/24

[52] U.S. Cl. ..... 122/510; 122/504; 126/278

[58] Field of Search ..... 122/504, 510; 126/51, 126/277, 278, 279

[56] References Cited

U.S. PATENT DOCUMENTS

| | | | |
|---|---|---|---|
| 178,917 | 6/1876 | Elliot | 126/279 |
| 1,416,916 | 5/1922 | Walker | 126/277 X |
| 2,724,401 | 11/1955 | Page | 122/504 X |
| 3,063,432 | 11/1962 | Bond et al. | 122/584 |
| 3,069,671 | 12/1959 | Taylor | 340/244 |
| 3,396,718 | 8/1968 | Anderson | 126/278 |

*Primary Examiner*—Edward G. Favors

*Attorney, Agent, or Firm*—John F. McClellan, Sr.

[57] ABSTRACT

A water damage preventer pan has a horizontal support arrangement for an appliance to be set down on but a bottom sloped to a drain, and an unusually sturdy construction; the construction is of unitary plastic and the horizontal support arrangement includes a plurality of blocks inside the perimeter buttressing a rim outside them, both joining a bottom which is wedge-shaped in section so that it can rest flat on a floor but can drain rapidly down a good slope.

8 Claims, 6 Drawing Figures

WATER DAMAGE PREVENTER PAN

This invention relates generally to containers and specifically to a pan system for catching spillage and leakage from appliances and draining same away.

SUMMARY OF THE INVENTION

In the prior art, it has been known to receive spilled or leaked water in a pan beneath an appliance and to have a drain connection to the pan. However, the usual arrangement can retain some water to rust bottom parts of appliances and with sluggish tendency to drain can clog up, through gradual accumulation of lint and other debris.

Pans of the general type are disclosed in U.S. Pat. No. 3,069,671 granted to L. M. Taylor on Dec. 18, 1962 and in U.S. Pat. No. 3,063,432 granted to D. R. Bond on Nov. 13, 1962.

A principal object therefore of the present invention is to provide a drain pan system which keeps appliances level and dry but which drains rapidly to sweep away deposits that otherwise would tend to clog the drain.

Further objects are to provide a system as described which itself is non-corrosive inside and out, which has a unitary pan and level provision, and which is safe, economical, durable and attractive in appearance.

BRIEF DESCRIPTION OF DRAWINGS

The above and other objects and advantages of this invention will become more readily apparent on examination of the following description, including the drawings in which like reference numerals refer to like parts.

DETAILED DESCRIPTION

Figure 1:
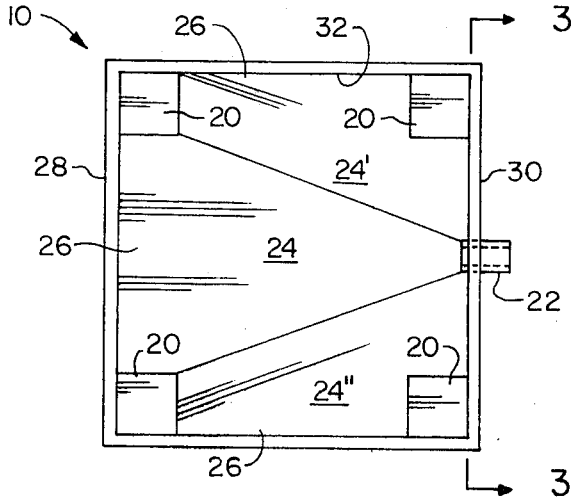
FIG. 1 is a plan view of a first embodiment.
Figure 2:
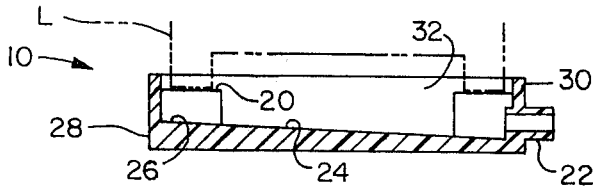
FIG. 2 is a side elevational view thereof in partial section.
Figure 3:
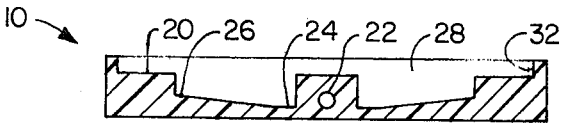
FIG. 3 is an end elevational view in partial section.

FIGS. 1 through 3 show the invention in embodiment 10. It comprises a rectangular pan system for catching overflows, seepage, condensation, spillage and other liquid discharge that could go onto the floor. The liquid caught is conveyed to a drainpipe and from there can go to a sump pump or other disposal means.

Although as noted, pans of the general type have been disclosed, the present invention features a level mount for an appliance, in pads or blocks 20 which have co-planar tops, all being the same height as measured from the underside of the pan, that is, from the floor on which the pan rests, but which has a sloped bottom that drains rapidly to sweep away accumulations of dust, lint and the like which might otherwise clog the drainpipe 22, and to minimize dampness.

For the rapid drain feature, this pan system has a tapered-thickness bottom 24 sloping down from the highest points 26 at a first end 28 to the drainpipe 22 which is centrally located at the second end 30. This wedge-shape in section provides a very sturdy construction.

Further advantages are apparent in that the rim 32 all around the pan is higher than the blocks and outside them, to prevent liquids sliding down the legs L of an appliance (phantom lines) from spilling out, and in that the entire pan-system may be unitary, molded or cast in one piece from thermoplastic such as polystyrene. There need be no seams between the plastic blocks and the plastic sides bottom and drain, so that not only is there no leadkage, but the unit is light weight and rust-free. The blocks can reinforce the sides at the corners as shown; the bottom can slope down at least in three planes 24, 24', 24'' indicated from sides and end, but the overall height can be relatively low for easier insertion beneath an appliance.

Figure 4:
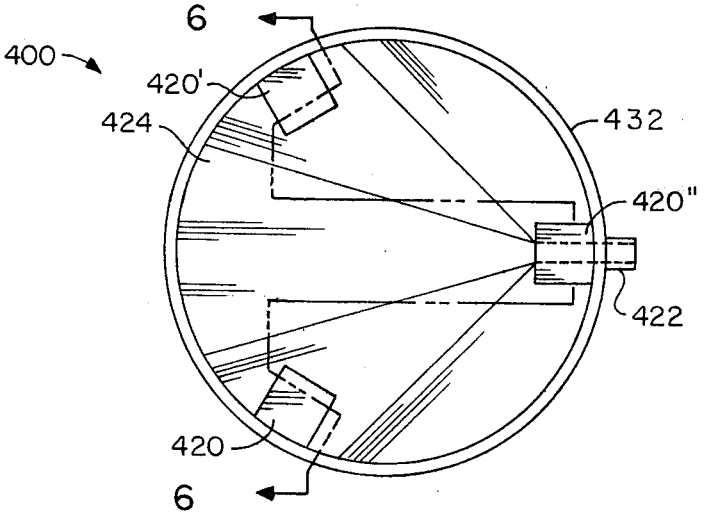
FIG. 4 is a plan view of a second embodiment.
Figure 5:
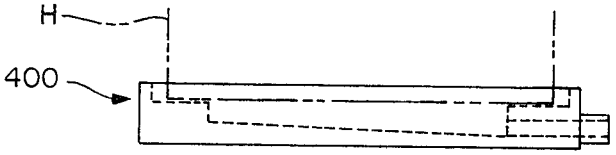
FIG. 5 is a side elevational view thereof.
Figure 6:
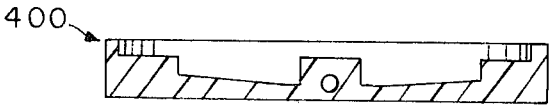
FIG. 6 is a sectional view, taken at 6—6, FIG. 4.

FIGS. 4 through 6 show a similar but circular embodiment 400 of the invention, with three co-planar blocks 420, 420' 420'' for supporting a customary three-legged (or a no-legs) water heater H (phantom lines), a drainpipe 422 is integral.

A rim 432 surrounds the base and is supported by the blocks. For better support the drain may pass through one of the blocks, 420'' shown.

From the above, it will be appreciated that, depending on location of a malfunctioning machine, floors, walls, ceilings, furniture and carpets will be better protected, both from the primary overflow and from clogging of the pan drain.

If desired, the invention may be permanently installed. If it is to be used for repairs to a malfunctioning washing machine, for example, the repairman has only to place the pan in the area where the washing machine is to be fixed, connect the drain to the washing machine drain or other drain at the same level or lower than the pan drain, place the washing machine on the blocks in the pan, and proceed with the repair.

As an example, a useful pan size would be 30 by 30 inches (75 by 75 cm). The bottom may be $\frac{3}{4}$ inch thick at the upper end and $\frac{1}{4}''$ at the drain end.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by U.S. Letters Patent is:

1. In a system of a pan with bottom, a rim and a drain for catching spillage from an appliance and draining same away, the improvement comprising: said bottom sloping to said drain from all points, and a plurality of blocks around the perimeter of the pan within said rim, said plurality of blocks having co-planar tops.

2. In a system as recited in claim 1, said system being unitary, of one-piece thermoplastic.

3. In a system as recited in claim 2, said blocks supporting said rim.

4. In a system as recited in claim 2, said bottom sloping provided by said bottom being wedge-shaped in section thickest away from said drain and thinnest proximate said drain.

5. In a system as recited in claim 2, said pan being rectangular in plan view.

6. In a system as recited in claim 2, said pan being circular in plan view.

7. In a system as recited in claim 6, said drain passing through a said block.

8. In a system as recited in claim 6, said drain including an integral drainpipe protrusion laterally from said bottom.

* * * * *